United States Patent [19]

Barrus et al.

[11] Patent Number: 4,969,513

[45] Date of Patent: Nov. 13, 1990

[54] HIGH PRESSURE AUTOMATIC KELLY VALVE

[75] Inventors: Reginald J. Barrus, Jefferson, La.; Donald J. Barrus, Los Alamintos, Calif.; Theodore A. Kritikos; John W. Owensby, both of New Orleans, La.

[73] Assignee: KOB, Inc., Gretna, La.

[21] Appl. No.: 410,889

[22] Filed: Sep. 22, 1989

[51] Int. Cl.[5] ..... E21B 34/02

[52] U.S. Cl. ..... 166/53; 137/493; 251/5; 166/326

[58] Field of Search ..... 166/53, 54, 166, 316, 166/319, 320, 323, 326; 137/493, 843; 251/5; 100/211; 425/417; 156/285, 286

[56] References Cited

U.S. PATENT DOCUMENTS

| | | | |
|---|---|---|---|
| 3,494,588 | 2/1970 | Kisling, III | 251/5 |
| 3,552,712 | 1/1971 | Whitlock | 251/5 |
| 3,566,964 | 3/1971 | Livingston | 166/326 |
| 3,717,203 | 2/1973 | Kirkpatrick et al. | 166/326 X |
| 3,955,594 | 5/1976 | Snow | 137/493 |
| 4,349,204 | 9/1982 | Malone | 166/187 X |
| 4,494,345 | 1/1985 | Peterson | 251/5 X |
| 4,628,996 | 12/1986 | Arnold | 166/187 X |
| 4,768,590 | 9/1988 | Sanford et al. | 166/187 |
| 4,790,344 | 12/1988 | Chauvier et al. | 251/5 |
| 4,832,120 | 5/1989 | Coronado | 166/187 |

FOREIGN PATENT DOCUMENTS

| | | | |
|---|---|---|---|
| 1116169 | 11/1961 | Fed. Rep. of Germany | 166/326 |
| 907365 | 10/1962 | United Kingdom | 166/224 |

*Primary Examiner*—William P. Neuder

*Attorney, Agent, or Firm*—Brisebois & Kruger

[57] ABSTRACT

A mud saver valve for automatically closing to prevent loss and spilling of drilling mud. The valve contains a diaphragm, rigid backup means and diaphragm support means so that the valve can be used in high pressure wells.

20 Claims, 3 Drawing Sheets

Fig- 6
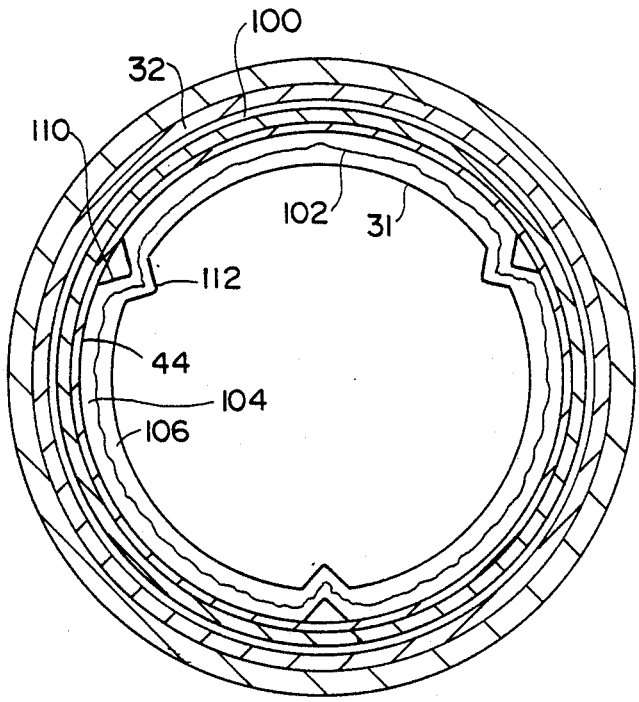
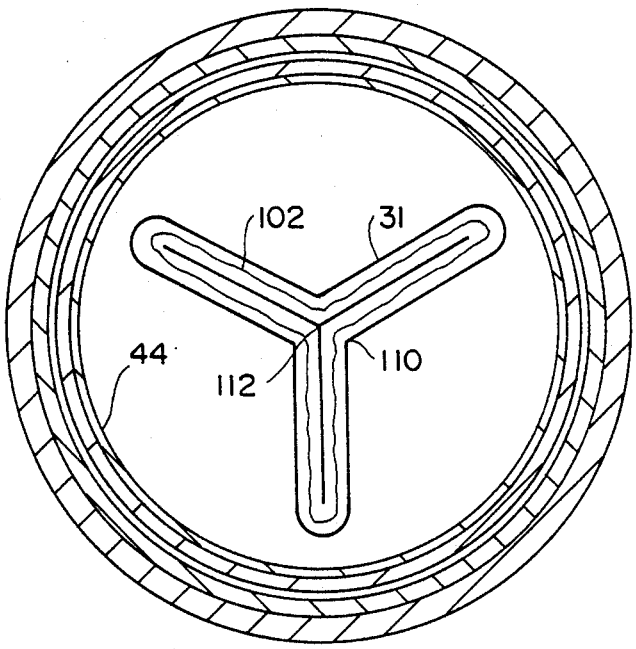
Fig- 7
Fig- 8
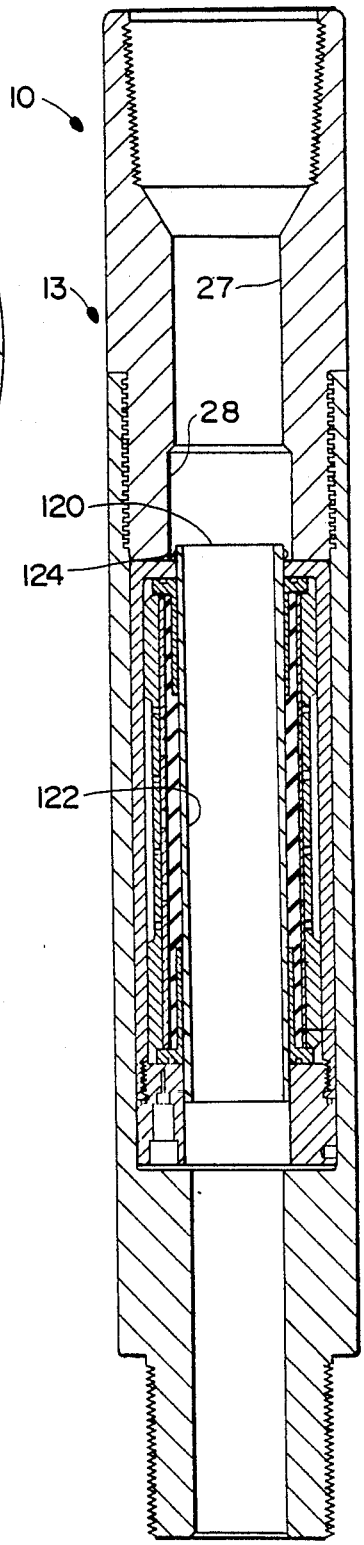

HIGH PRESSURE AUTOMATIC KELLY VALVE

This invention relates generally to a kelly valve, often called a mud saver valve, which closes automatically to prevent loss and spilling of drilling mud, and particularly to such a valve which can withstand very high drilling mud pressures, for example, the pressures required for drilling wells over 20,000 feet deep, where mud pressure can be as high as 15,000 psi.

BACKGROUND OF THE INVENTION

In the drilling of wells, drilling mud is circulated through the drill string to contain the well, lubricate the bit, and remove cuttings from the bore hole. The drilling mud is pumped through a Kelly at the top of the drill string at a pressure sufficient to flow down through the interior of the drill string to the bit at the bottom of the string and then upwardly through the annulus between the string and wall of the bore hole to remove cuttings.

From time to time, the pump is stopped and the kelly is disconnected from the drill string, for example, to add or remove pipe sections from the string, or to replace the bit, which requires pulling the entire string. A considerable amount of drilling mud remains in the kelly and can flow or drain from the lower end of the kelly when it is disconnected from the drill string.

Mud draining from the kelly usually spills on the floor of the drilling rig and causes unsafe conditions for workmen, and can cause pollution if the mud flows along the ground. Time is lost because it is usually necessary for the workmen to wait until the mud has drained from the kelly before another connection can be made to the drill string, and the mud lost is expensive.

During drilling of a 20,000 foot well, the drill string is disconnected from the Kelly about 800 times. Depending on the diameter of the string several thousand gallons of mud could be lost.

Mechanical Kelly valves with metal valve parts exposed to the abrasive mud are not satisfactory because they wear rapidly, often lock up when clogged with mud, and usually have parts or projections which prevent tools from being pumped through the valve into the well.

Kelly valves with a flexible tubular body, which closes automatically under the action of compressed fluid in a chamber surrounding the body are known, as described for example, in U. S. Pat. No. 4,303,100.

While the valve of U.S. Pat. No. 4,303,100 may operate satisfactorily when drilling relatively shallow wells of a few thousand feet, the flexible body is damaged at the very high pump pressures required for deep drilling, and the valve is then useless. In particular, these very high pressures in the drill string extrude the diaphragm material through the small openings in the back up sleeve and the diaphragm either punctures or fastens itself to the backup sleeve so it will not close when pumping pressure is released.

As the drilling depth increases, more pump pressure is required to pump the mud through the well, and pressures on the order of several thousand psi are not unusual for deep wells.

SUMMARY OF THE INVENTION

It has been found that the basic problem which is encountered in flexible or collapsible diaphragm Kelly valves is that a diaphragm which is sufficiently flexible to collapse and close under the action of a reasonable fluid pressure, is also sufficiently flexible to extrude through virtually any opening in a containment or backup sleeve. Further, the material of the diaphragm, while flexible, tends to be pressure molded at the very high mud pump pressures required for deep well drilling.

Flow passages must be provided behind the diaphragm to enable the pressurized closing fluid to act on and collapse the diaphragm to close the mud flow passage when the mud pressure is released, and to enable the closing fluid to escape from behind the diaphragm so the diaphragm will fully open in response to the mud pressure during pumping. It is these openings that have caused failures of the prior known valve diaphragms at very high pressures.

In accordance with the invention, such failure of the diaphragm is avoided by providing behind the diaphragm, a diaphragm support having openings, and which is so close to a back up element behind the diaphragm support, that the material of the diaphragm cannot extrude through the openings of the support when subjected to very high mud or pump pressures.

Such failure is also avoided, in accordance with the invention, by providing a support which is elastic, and positioned very close to a rigid back up element so that the mud or pump pressure acting on the diaphragm is transmitted by the diaphragm to the support to deform or expand the support against the rigid back up element, thereby closing the openings in the support so the diaphragm material cannot extrude through the support openings. The diaphragm support is initially sufficiently close to the back up element that the deformation of the support does not exceed the elastic limit of the support. Such deformation of the support within its elastic limit enables the support to return to its original shape after deformation so that the pressurized fluid behind the diaphragm can flow through the support openings to close the mud passage, when mud pressure is relieved, and can allow the mud flow passage to fully open by venting the pressurized closing fluid from behind the diaphragm when the mud is again pressurized.

In accordance with another aspect of the invention, the openings in the diaphragm support are so configured and dimensioned that the diaphragm is not damaged when pressed against the support by very high mud pressures.

In accordance with another aspect of the invention, the diaphragm support has a relatively thin wall to minimize the extent of deformation of the diaphragm material which is forced into the openings when the support is seated against the backup element.

In accordance with another aspect of the invention, the sidewall of the diaphragm has three or more elongated inwardly extending indentations to facilitate complete closing of the diaphragm under the action of the fluid pressure applied behind the diaphragm.

Accordingly, it is an object of the invention to provide a mud saver valve having a pressurized flexible diaphragm which closes a mud flow passage in response to pressurized fluid applied behind the diaphragm, and opens in response to mud pumping pressure, and which can be used with very high mud pressures without damage to the diaphragm.

Another object is a mud saver valve with a diaphragm support having openings therein for flow of pressurized closing fluid, and which is sufficiently close to a backup element behind the support that at high mud pressure, the diaphragm material does not extrude through the openings in the support.

A further object is a mud saver valve in which the mud pressure is transmitted to the support by the diaphragm, there is a clearance space between the support and the back up element for flow of pressurized valve closing fluid toward and away from the rear of the diaphragm, and the support is arranged to deform or deflect toward the back up element to decrease the clearance space and thereby prevent the diaphragm from extruding through the flow passages into the region behind the support.

A further object is a mud saver valve in which the back up element behind the support has flow passages for the pressurized valve closing fluid, and the openings in the support are offset from the passages in the backup element so that the pressurized fluid to operate the valve flows through the clearance space between the back up element and the support, and the support deforms toward the back up element to reduce the clearance space as the mud pressure increases.

A further object is a mud saver valve in which the support has a thin wall so that the diaphragm material can be forced into the support openings only a short distance before it engages the inner surface of the backup element.

A further object is a mud saver valve according to one or more of the above objects, in which the support deflects or expands into engagement with the backup element thereby closing the openings in the support against the backup element and preventing the diaphragm from being forced through the openings by high mud pressures.

A further object is a mud saver valve according to one or more of the above objects in which the openings in the diaphragm support are configured to avoid damage to the diaphragm at very high pressures.

A further object is a mud saver valve according to one or more of the above objects which is incorporated into a sub in which the pressurized valve closing fluid is sealed so that the sub requires no connections except to the kelly and the drill string.

A further and additional object is a mud saver valve according to one or more of the above objects into which a lock open or hold open sleeve can be pumped or dropped to hold the valve open for working or servicing the well.

Another object is a self closing diaphragm valve which opens in response to a predetermined pressure acting on the inner surface of the diaphragm, and which is not damaged by very high pressures on the inner surface of the diaphragm.

Another object is a mud saver valve in the form of a tubular diaphragm having inwardly extending indentations in its sidewall which engage and seal against each other when the diaphragm is collapsed to its closed position, to enable complete closing of the diaphragm.

Another object is a mud saver valve in which the valve is wholly contained in a capsule within a sub adapted to be connected to the drill pipe, and the capsule can be removed from the sub in the field for replacement and servicing.

Other objects, features, and advantages of the invention will become apparent from the drawings, and the description which follows.

BRIEF DESCRIPTION OF THE DRAWINGS

FIG. 6 is a view in section taken along line 6—6 of FIG. 1 and shows the diaphragm in a relaxed open condition;

FIG. 7 is a view in section corresponding to FIG. 6 but showing the diaphragm closed; and FIG. 8 is view corresponding to FIG. 1 and showing a lock open sleeve positioned in the mud saver valve.

DETAILED DESCRIPTION

Figure 1:
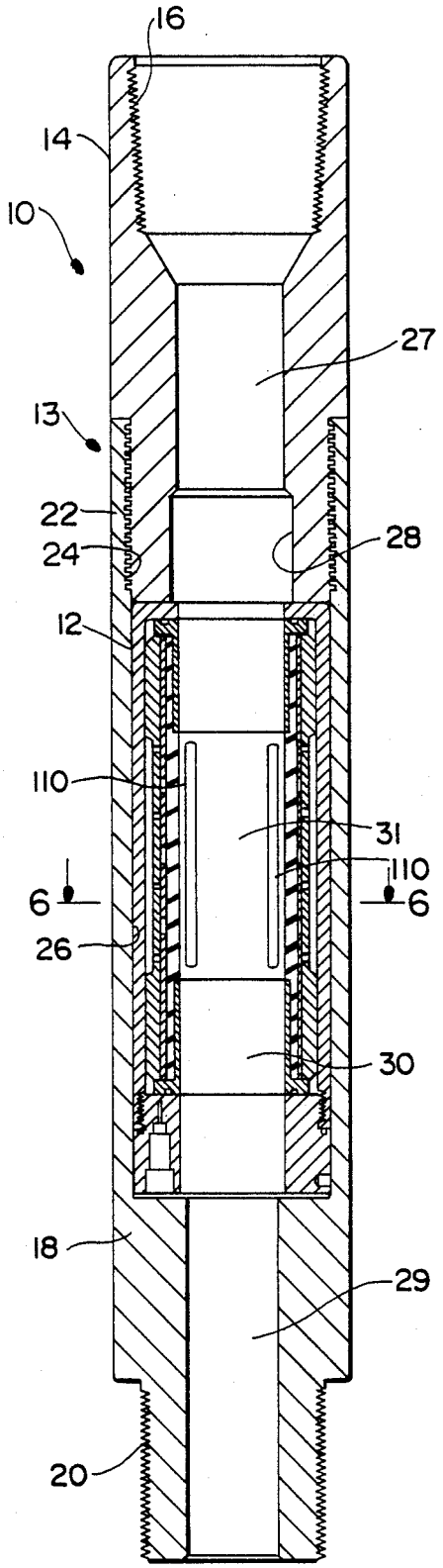
FIG. 1 is a view in longitudinal section of a sub containing the mud saver valve of the invention, and shows the valve open.
Figure 2:
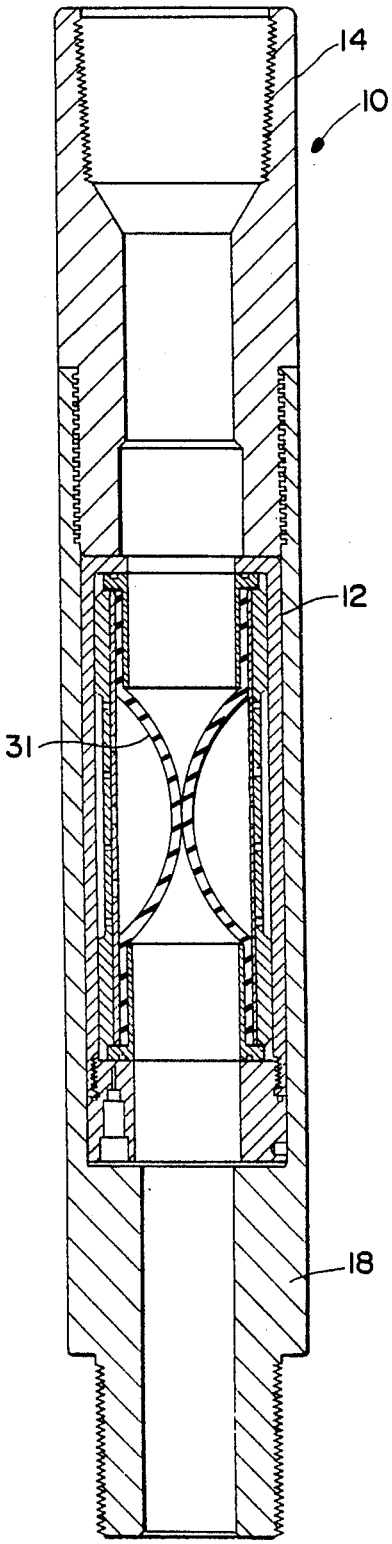
FIG. 2 is a view corresponding to FIG. 1 and showing the valve closed.

FIGS. 1 and 2 show a kelly or mud saver valve assembly 10 according to the invention. The assembly includes a removable capsule 12 which advantageously contains all the operating elements of the valve. The capsule 12 is housed in a sub 13 composed of an upper body 14 with an internally threaded box end 16 adapted to be connected to a kelly (not shown), and a lower body 18 with an externally threaded pin end 20 adapted to be connected to a drill string (not shown).

The upper body 14 has a male thread 22 which is screwed into a female thread 24 of the lower body 18 after the capsule 12 is inserted into the cylindrical interior 26 of the lower body 18. The capsule 12, upper body 14, and lower body 18 are so dimensioned that when the bodies are tightly threaded together, the capsule 12 is held against axial movement in sub 13.

Upper body 14 has a central flow passage 27 and an annular recess 28 above capsule 12. Lower body 18 has a central flow passage 29.

FIG. 2 shows the valve in the closed position in which mud flow through the valve is blocked, and FIG. 1 shows the valve in the open position in which mud or other fluids can flow through the valve.

Capsule 12 has a central flow passage 30 aligned with the passages 27 and 29 when the sub 13 is assembled.

As will soon be described in greater detail, the valve element takes the form of a tubular flexible diaphragm 31 which forms a wall of the flow passage 30. The diaphragm 31 is forced to the closed position of FIG. 2 by pressurized gas in the region around or behind the diaphragm, and is forced to the open position of FIG. 1 by mud or other liquid in the flow passage 30 when the pressure of the liquid exceeds the pressure of the gas behind the diaphragm.

Figure 3:
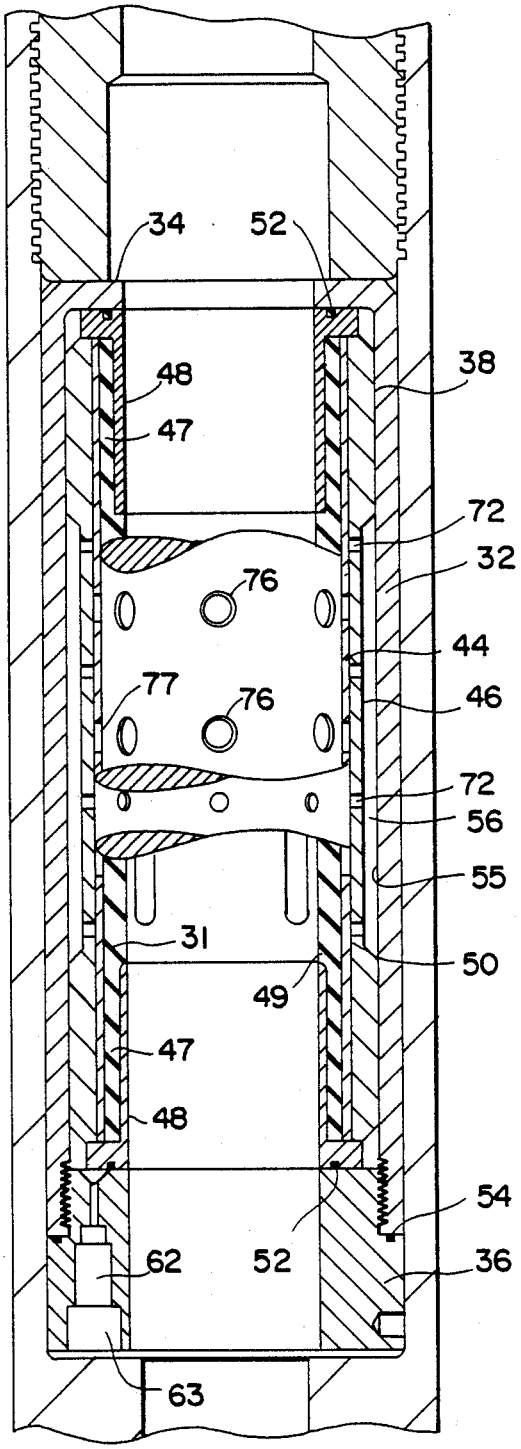
FIG. 3 is an enlarged view in longitudinal section corresponding to FIG. 1 and showing details of the mud saver valve and its capsule.

As shown at FIG. 3, Capsule 12 includes an outer tubular body 32 with an inwardly extending flange 34 at one end, and an internal thread at the other end to receive a threaded annular end 36. Within the outer body 32 is a diaphragm assembly 38 including the tubular diaphragm 31, within a diaphragm support sleeve 44 which is within a rigid backup element in the form of a sleeve 46. The respective ends 47 of the diaphragm are secured to the diaphragm support sleeve by tubular end members 48 which are mechanically expanded, after insertion of these end members 48 into the assembly of diaphragm 31, diaphragm support sleeve 44, and backup sleeve 46, to tightly clamp a length of each end of the diaphragm and the support sleeve against the back up sleeve. Such clamping seals the ends 47 of the diaphragm so that the inner surface 49 of the diaphragm is sealed with respect to its outer surface 50, and well fluids cannot enter the region around the outer surface of the diaphragm.

The diaphragm assembly 38 is inserted in the outer body 32, and the end 36 is then threaded into the body. An O-ring 52 in the outer end face of each end member 48, and an O-ring 54 on a shoulder of end 36 seal the region between the outer surface 50 of the diaphragm and the inner surface 55 of the outer body 32.

As shown at FIG. 3, the outer surface of backup sleeve 46, is of reduced diameter, inwardly of its ends, to provide an annular chamber 56 behind and outwardly of the outer surface 50 of the diaphragm 31. This chamber 56 is filled with gas under pressure through a filler port 62 in end 36 which is then closed with a plug 63 to retain the pressure.

The backup sleeve 46 has a plurality of gas flow openings 72 which extend through the sleeve from the chamber 56 to the interior of the sleeve. In the form of sleeve 56 shown in the drawings, there are four sets of equally circumferentially spaced openings 72, with eight openings in each set. The openings 72 of a set are in a plane perpendicular to the axis of the sleeve, and the sets are equally spaced apart along the axis of the sleeve.

The support sleeve 44 has three sets of openings 76 which are respectively midway between the sets of openings 72. Each opening 76 is countersunk or bevelled from the inside of sleeve 44 to provide a smooth frustoconical surface 77 which faces toward the outer surface 50 of the diaphragm. A preferred countersink angle is 45 degrees i.e. the frustoconical surfaces 77 of each opening 76 slope at an angle of about 45 degrees to the axis of the opening, although an angle in the range of 20 to 50 degrees is satisfactory.

Figure 4:
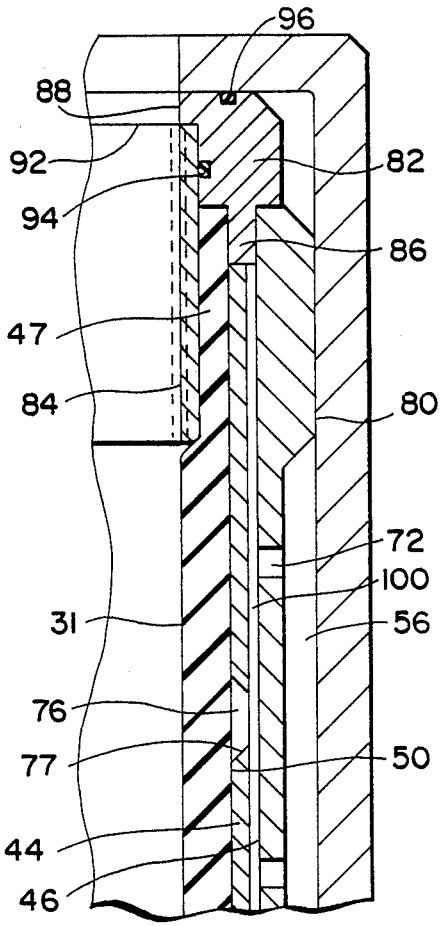
FIG. 4 is an enlarged partial view in longitudinal section showing a variation of the end structure of the diaphragm assembly.

FIG. 4 shows another diaphragm assembly 80 which is similar to the diaphragm assembly 38 but has different ends. Diaphragm assembly 80 includes the diaphragm 31, support sleeve 44, and backup sleeve 46. At each end of assembly 80 is an end ring 82 and a separate clamping sleeve 84. End ring 82 has an annular projection 86 of an outer diameter to be a close sliding fit into backup sleeve 46 and an inner diameter about the same as the inner diameter of support sleeve 44.

To assemble the diaphragm assembly 80, diaphragm 31 is inserted into support sleeve 44 and the support sleeve is then inserted into the backup sleeve 46. The clamping sleeve 84 which initially (as shown in dotted lines) has an outside diameter only slightly greater the diameter of inner surface 88 of end ring 82 is then pushed a short distance into the end of diaphragm 31. End ring 82 is then pushed over clamping sleeve 84 and into the end of backup sleeve 46. As end ring 82 is pushed in, its shoulder 92 engages the end of clamping sleeve 84 to push the clamping sleeve to the dotted line position shown at FIG. 4. The clamping sleeve is then mechanically expanded with a tool such as an expanding mandrel, so that its inner diameter is the same as or slightly larger than the diameter of inner surface 88 of the end ring. An O-ring 94 seals the outer surface of clamping sleeve 84 to the inside of the end ring 82.

Thus, the end 47 of the diaphragm 31 is deformed and tightly clamped between the outer surface of clamp ring 84 and the inner surface of backup sleeve 46. The diaphragm assembly 80 can then be inserted into capsule body 32, and end 36 is then threaded into the body. O-rings 96 at each end of diaphragm assembly 80 seal against the inner end faces of the body and end of the capsule 12.

For purposes of explanation, FIG. 4 shows a somewhat exaggerated clearance space 100 between the outer surface of support sleeve 44 and the inner surface of backup sleeve 46.

Gas pressure in the chamber 56 closes the valve by deforming the diaphragm to the condition shown at FIG. 2, when well fluid pressure is below a predetermined value. The gas under pressure flows from chamber 56 through openings 72 in backup sleeve, then through the clearance space 100 between the support sleeve 44 and backup sleeve 46, and then through the openings 76 to the region surrounding the outer surface 50 of the diaphragm. When well pressure increases, and the pressure within diaphragm becomes greater than the gas pressure in chamber 56, gas is forced out of the region between the diaphragm and the support sleeve by again passing through openings 76 and clearance space 100 to openings 72. The support sleeve 44 thus acts like a two way valve at low pressure, but completely closes at high well fluid pressures.

Figure 5:
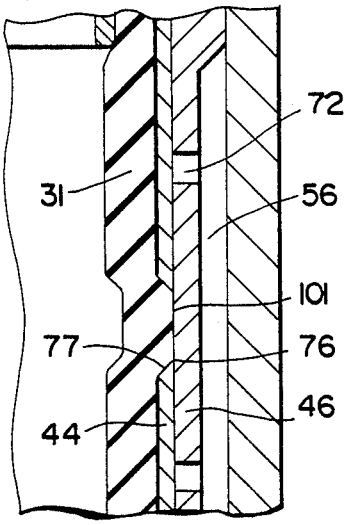
FIG. 5 is an enlarged partial view showing manner in which the diaphragm support is elastically deformed into engagement with the backup element to close the open in the wall of the diaphragm support.

As the pressure acting on the inner surface 49 of the diaphragm increases, the diaphragm opens to the position shown at FIGS. 1, 3 and 4 in which the diaphragm presses against and is supported by the support sleeve 44. Further increase of the pressure in the drill string is transmitted to the support sleeve by the diaphragm and causes the support sleeve to expand and close the clearance space 100 between the support sleeve 44 and the backup sleeve 46. In this condition, as shown at FIG. 5, the outer ends of the openings 76 are substantially closed and diaphragm material 101 in the openings 76 is supported by the backup sleeve. Since the clearance space is closed, the diaphragm material 101 cannot extrude through the openings 76 of the support sleeve 44. Thus, the pressure which the diaphragm can withstand without damage is limited only by the pressure the support sleeve and backup sleeve can sustain without bursting.

When this high interior pressure is discontinued to add or remove pipe sections, the sleeve 44 must contract to again provide the clearance space 100 for the flow of pressurized gas from chamber 56, through openings 72, clearance space 100, and openings 76 to the outer surface of the diaphragm.

The clearance space between the support sleeve 44 and the backup sleeve is sufficiently small that the expansion of the support sleeve 44 is within the elastic limit of the material of this sleeve. In addition, the material of sleeve 44 must not acquire a permanent set at the expected high pressure within the diaphragm. A sleeve 44 of steel satisfies these requirements for wells 20,000 feet deep and deeper, although a sleeve of a plastic material is satisfactory for shallower wells of up to 5000 feet.

The radial dimension of the clearance space 100, and the wall thickness of the support sleeve 44 and back up sleeve depend on the diameter of the kelly valve and thus the diameters of these sleeves. Where the drill pipe is nominal 4 inch diameter, a support sleeve 44 of about 4⅛ inches O.D. with a wall thickness on the order of 0.2 inches, and a backup sleeve with an I.D. on the order of 0.01 to 0.02 inches greater than the O.D. of the support sleeve has been found to be satisfactory. The radial clearance is thus on the order of 0.005 to 0.010 inches when the support sleeve is relaxed. Openings 72 are about ½ inch diameter, and small ends of openings 76 are about ½ in diameter. Diaphragm 31 can be of nitrile or neoprene of ⅜ inch wall thickness, with a central 2, 3, or 4 ply braided polyester reinforcement.

A preferred form of diaphragm 31 is shown at FIG. 6. The diaphragm has a central ply 102 of braided polyester or KEVLAR reinforcing sandwiched between an outer layer 104 and an inner layer 106 of nitrile or neoprene. The diaphragm is molded and has equally circumferentially spaced indentations 110 in its side wall which extend inwardly a distance about equal to the thickness of the side wall of the diaphragm to provide inner tips 112. As shown at FIG. 1, these indentations 110 are axially centered between the clamped ends 47 and are elongated and extend from slightly below the upper clamp ring 48 to slightly above the lower clamp ring 48.

FIG. 7 shows the diaphragm of FIG. 6 in its collapsed or closed condition. In this closed condition, the inner tips 112 of the indentations engage and seal against each other so that the passage through the diaphragm is completely closed and sealed. The indentations 110 also define the fold lines of the diaphragm when it collapses under the action of the pressurized gas.

While a reinforced tubular diaphragm like that of FIG. 6 without the indentations 110 can be used, the wall thickness and strength are such that it is almost impossible for the diaphragm to completely close under the action of a reasonable gas pressure in chamber 56. The extent of closing of such a tubular diaphragm without indentations is satisfactory for drilling mud which is thick and viscous, but is found to leak when thinner fluids such as water are pumped through the Kelly.

It is to be appreciated that the kelly valve of the invention can be used for drilling relatively shallow wells of perhaps a few thousand feet, as well as deep wells on the order of 20,000 feet and deeper. The pressure in the region around or behind the diaphragm is the pressure required to close the valve when the mud pump is shut off, to prevent loss of the column of mud in the kelly above the valve. It has been determined that a gas pressure of about 80 psi is satisfactory.

When drilling at relatively shallow depth, the diaphragm support sleeve can be spaced from the backup sleeve i.e. the well fluid pressure may not be great enough to expand the support sleeve into engagement with the backup sleeve. There is no danger of damage to the diaphragm under these conditions since the clearance space between the support sleeve and the backup sleeve is sufficiently small initially, and the diaphragm material is sufficiently tough that the diaphragm material cannot extrude into this space at relatively low well fluid pressures. However, as the pressure acting on the inner surface of the diaphragm increases, the support sleeve expands to decrease the clearance space, and at very high mud or well fluid pressures, seats against the backup sleeve so the clearance is essentially zero to prevent extruding the diaphragm material at the enormous pressures encountered at when drilling at 20,000 feet and deeper.

While the backup sleeve is shown and described as having passages which extend radially through the backup sleeve 46, longitudinal passages along the inner surface of this sleeve could be used, to communicate with a chamber at, for example, an end of the this sleeve. These passages could take the form of shallow grooves in regions of the backup sleeve circumferentially offset from the openings in the support sleeve.

For emergencies such as use of wire line tools, it may be necessary to hold the mud saver valve 10 open. As shown at FIG. 8, a lock open sleeve 120 is provided which can be dropped or pumped through the Kelly into the passage of the diaphragm to lock the diaphragm open. The lock open sleeve 120 has a thin side wall 122 of a length greater than the exposed length of the diaphragm, and spring loaded detents 124 at its upper ends. These detents 124 are compressed while within the bore of passage 27, and expand in the recess 28 to lock against the top edge of capsule 12, as shown at FIG. 8. The sub 13 is disassembled to remove the lock open sleeve 120.

To dissassemble the sub, the upper body 14 is unthreaded from the lower body 18, and the capsule 12 can then be removed for servicing such as removal of lock open sleeve 120, when used. Since the capsule 12 contains all the operating components of the valve including the pressurized fluid for closing the valve, the capsule can be replaced in the sub in the field, at the drilling site. Thus, only a single sub 13 and perhaps one or two extra capsules 12 can be provided at the drilling site, to allow replacement of the valve in the event of failure, or to avoid loss of time if the drop sleeve cannot be extracted after the sub is dissassembled.

Changes and variations can be made without departing from the scope of the invention.

We claim:

1. A mud saver valve comprising, a body having a flow passage therethrough, and being adapted to be connected to a drill pipe, a flexible diaphragm in said body forming a wall of the flow passage in the body along a portion of the length of the body, said wall having an inner surface facing the flow passage, and an outer surface sealed relative to the inner surface, said diaphragm being responsive to the pressure of well fluids acting on said inner surface to open said flow passage, and being responsive to pressure applied to said outer surface to close said flow passage when the pressure on said inner surface is below a predetermined value, relatively rigid backup means between said body and the outer surface of said diaphragm, diaphragm support means between said outer surface of said diaphragm and said backup means, said diaphragm support means having openings therethrough for the flow of pressurized fluid toward and away from said outer surface of the diaphragm, said diaphragm support means being spaced from said backup means by a clearance space smaller than the space into which the material of the diaphragm can extrude at the mud pressure acting on the diaphragm, and passage means in said backup means communicating with said openings in said diaphragm support means through said clearance space, and offset relative to said openings in said diaphragm support means to allow pressurized fluid to escape from the space between the outer surface of the diaphragm and the diaphragm support means.

2. A mud saver valve according to claim 1 wherein said diaphragm support means comprises, means responsive to the force exerted thereon by the diaphragm for deforming toward said backup means to reduce the clearance space between the support means and the backup means, as the pressure acting on the inner surface of the diaphragm increases.

3. A mud saver valve according to claim 2 wherein said diaphragm support means comprises means responsive to mud pressures acting on said inner surface of the diaphragm for deforming into engagement with the backup means without exceeding the elastic limit of said diaphragm support means.

4. A mud saver valve according to claim 1 wherein said openings in said diaphragm support means comprise openings having bevelled mouths facing toward said outer surface of the diaphragm.

5. A mud saver valve according to claim 4 wherein said diaphragm support means comprises a thin wall support so that at high mud pressures, the diaphragm material is forced into said openings only to the extent of the thickness of said thin wall.

6. A mud saver valve comprising, a tubular body having a flow passage therethrough, and being adapted to be connected to a well pipe, a flexible tubular diaphragm in said body forming a wall of the flow passage in the body along at least a portion of the length of the body, said diaphragm having an inner surface facing the flow passage, and an outer surface sealed relative to the inner surface, said diaphragm being responsive to well fluid pressure acting on said inner surface to open said flow passage, and being responsive to pressure applied to said outer surface to collapse the diaphragm and close said flow passage when the pressure on said inner surface is below a predetermined value, relatively rigid tubular backup means between an outer wall of said body and the outer surface of said diaphragm, diaphragm support sleeve means between said outer surface of said diaphragm and said tubular backup, said diaphragm support sleeve means having openings for the flow of pressurized fluid therethrough toward and away from said outer surface of the diaphragm, said diaphragm support sleeve means being spaced from said tubular backup means by a clearance space smaller than the space into which the material of the diaphragm can extrude when high fluid pressures act on said inner surface of said diaphragm, and passage means in said tubular backup means communicating with said openings in said diaphragm support sleeve means through said clearance space, and offset relative to said openings in said diaphragm support means to allow pressurized fluid to escape from the space between the outer surface of the diaphragm and the diaphragm support means.

7. A mud saver valve according to claim 6 wherein said diaphragm support sleeve means comprises means responsive to the force exerted thereon by the diaphragm, when the pressure acting on the inner surface of the diaphragm exceeds a determined value, for elastically deforming toward said tubular backup means to reduce the clearance space between the support sleeve means and the tubular backup means.

8. A mud saver valve according to claim 6 wherein said diaphragm support sleeve means comprises means responsive to pressure acting on said inner surface of the diaphragm for deforming into engagement with the tubular backup means without exceeding the elastic limit of the diaphragm support means.

9. A mud saver valve according to claim 6 wherein said diaphragm support sleeve means comprises means responsive to very high mud pressures for deforming into engagement with the tubular backup means without exceeding its elastic limit, and wherein, such deformation closes the clearance space between the diaphragm support sleeve means and said tubular backup means to prevent extruding material of the diaphragm between the diaphragm support sleeve means and the tubular backup means.

10. A mud saver valve according to claim 9 wherein said support sleeve means has a thin wall so that the extent of deformation of the diaphragm into the support sleeve openings at high mud pressures is limited to the thickness of the support sleeve.

11. A mud saver valve according to claim 10 wherein said openings in said diaphragm support sleeve comprise openings having bevelled mouths facing toward said outer surface of the diaphragm.

12. A mud saver valve according to claim 6 wherein said tubular backup means comprises a metal tube, said diaphragm support sleeve means comprises a metal sleeve of a wall thickness less than the tube, and said metal sleeve has an outside diameter less than the inside diameter of the metal tube of the backup means.

13. A mud saver valve according to claim 6 wherein said diaphragm is comprised of a tube of polyester reinforced nitrile.

14. A mud saver valve according to claim 6 wherein said diaphragm is comprised of a tube of polyester reinfored neoprene.

15. A mud saver valve according to claim 8 wherein said tubular diaphragm comprises a tube having spaced apart inwardly extending indentations in the sidewall thereof, said indentations extending generally axially along the tube.

16. A mud saver valve according to claim 15 wherein there are at least three of said indentations equally spaced apart circumferentially of the tube.

17. A mud saver valve according to claim 6 wherein said tubular body has a recess therein within said flow passage for receiving latching elements of a lock open sleeve adapted to be pumped into the flow passage of said body to hold the diaphragm open.

18. A mud saver valve according to claim 17 wherein said lock open sleeve comprises a tubular sleeve of an outside diameter slightly less than the diameter of said flow passage in said body and of a length greater than the axial length of said diaphragm.

19. A mud saver valve according to claim 6 wherein said diaphragm is comprised of a tube of KEVLAR reinforced nitrile.

20. A mud saver valve according to claim 6 wherein said diaphragm is comprised of a tube of KEVLAR reinforced neoprene.

* * * * *